United States Patent [19]

McCullough

[11] 4,123,014

[45] Oct. 31, 1978

[54] YARN TENSION CONTROL

[75] Inventor: Robert W. McCullough, Spartanburg, S.C.

[73] Assignee: Milliken Research Corporation, Spartanburg, S.C.

[21] Appl. No.: 855,039

[22] Filed: Nov. 25, 1977

Related U.S. Application Data

[63] Continuation of Ser. No. 779,292, Mar. 21, 1977, abandoned.

[51] Int. Cl.[2] ..... B65H 59/24

[52] U.S. Cl. ..... 242/152.1

[58] Field of Search ..... 242/152.1, 147 M, 149, 242/150 M; 57/58.86

[56] References Cited

U.S. PATENT DOCUMENTS

| | | | |
|---|---|---|---|
| 2,614,773 | 10/1952 | Ammerall | 242/150 M |
| 2,620,617 | 12/1952 | Bley | 242/152.1 UX |
| 2,650,779 | 9/1953 | Uhlig | 242/152.1 X |
| 2,677,511 | 5/1954 | Bley | 242/152.1 X |
| 3,100,091 | 8/1963 | Mindheim et al. | 242/150 M |
| 3,309,858 | 3/1967 | Franzen | 57/58.86 |
| 3,372,888 | 3/1968 | Eppendahl | 242/150 M |
| 3,709,332 | 1/1973 | Rosen | 242/150 M UX |
| 3,991,954 | 11/1976 | Schwartz | 242/150 M |

FOREIGN PATENT DOCUMENTS

| | | | |
|---|---|---|---|
| 864,073 | 1/1953 | Fed. Rep. of Germany | 242/150 M |
| 1,061,239 | 7/1959 | Fed. Rep. of Germany | 242/152.1 |
| 47-7375 | 7/1962 | Japan | 242/150 M |
| 48-4726 | 4/1963 | Japan | 242/150 M |

*Primary Examiner*—Stanley N. Gilreath

*Attorney, Agent, or Firm*—Earle R. Marden; H. William Petry

[57] ABSTRACT

A method and apparatus to adjustably control the tension of yarn by the application of a magnetic force on a metallic ball or roller being used to apply a restrictive force on the yarn passing through a tension applying device.

2 Claims, 3 Drawing Figures

YARN TENSION CONTROL

This is a continuation of application Ser. No. 779,292, filed Mar. 21, 1977, now abandoned.

It is an object of the invention to provide for ready adjustment of the tension applied to a yarn in a device such as that shown in U.S. Pat. Nos. 3,753,535, 3,874,613 or 3,892,371.

Other objects of the invention will become readily apparent as the specification proceeds to describe the invention with reference to the accompanying drawing, in which.

Figure 1:
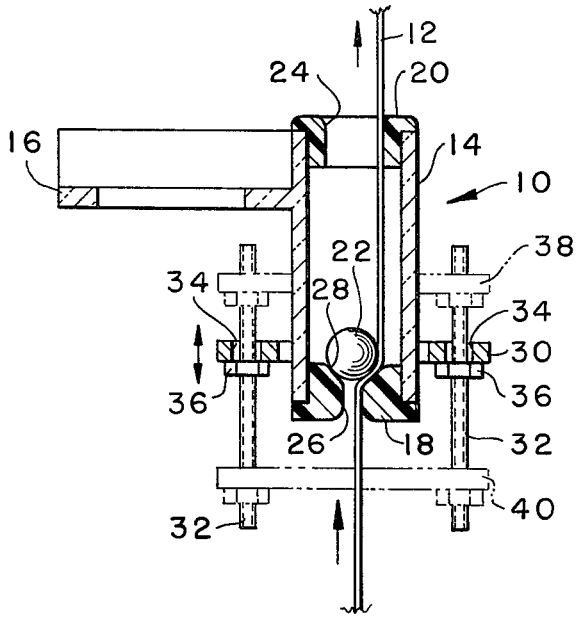
FIG. 1 is a cross-section view taken on line 1—1 of FIG. 2 showing the improved tension control.

Referring now to the drawings, the tension control device 10 is shown in cross-section in FIG. 1 with the yarn 12 passing upward in the direction indicated by the arrows. The tension control device 10 consists basically of a housing 14, a mounting support bracket 16, a pair of ceramic eyelets 18 and 20 mounted in the housing 14 and spherical metallic tension application member 22. Preferably the diameter of the opening 24 in the upper eyelet 20 will be greater than the diameter of the opening 26 in the lower eyelet 18. The opening 26 is tapered at 28 to provide a seat for the ferrous metal ball 22 which, depending on its size and weight, provides a restrictive force on the yarn 12 as it passes through the device 10.

Since it is very difficult to match the desired tension in the yarn 12 and the force exerted by the ball 22 due to fluctuations in input tension as well as fluctuations in output tension, it is desired to provide a means to adjust the force exerted by the ferrous metal ball 22. To this end, a permanent toroidal shaped magnet 30 is mounted around the device by suitable means such as threaded rods 32 which are smaller in diameter than holes 34 in the magnet 30. Magnet 30 is held in the desired position by nuts 36 threaded on the rods 32.

The solid line position of the magnet 30 in FIG. 1 is the normal operating position but if it is desired to decrease the tension by lessening the force of the ball 22, the nuts 36 will be threaded upward to position 38 so that the magnet exerts an upward force on the ball 22 in opposition to the gravitational force on the ball. Conversely, if it is desired to increase the force of the ball 22 on the yarn 12, the magnet will be lowered to position 40 where the magnet will exert a downward pulling force on the ball 22 which, in conjunction with the gravitational pull on the ball, will increase the effective force.

As discussed above, the preferred location of the magnet 34 is around the housing 14 of the tension control but obviously other locations can be selected as long as the objective of the invention, the application of a magnet force to the ball 22, is achieved. As an example, either of the eyelets 18 or 20 or the housing 14 could be of magnetic material if desired.

In the preferred form of the invention, a permanent magnet is used but alternately an electromagnet can be employed. If a D.C. electromagnet is employed, the magnet can be fixed relative to the tension control device and the effect of the magnet on the ferrous ball can be altered by the control of the direction and amount of current to the coil of the electromagnet.

Figure 2:
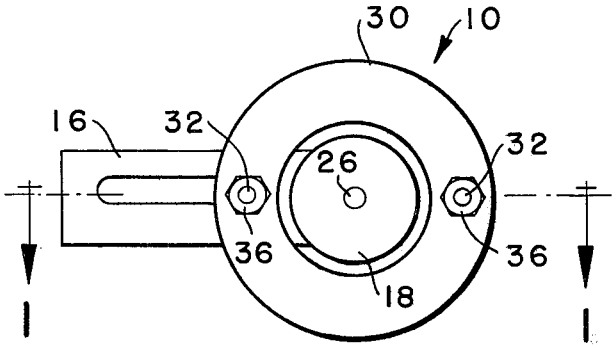
FIG. 2 is a bottom view of the device shown in FIG. 1.
Figure 3:
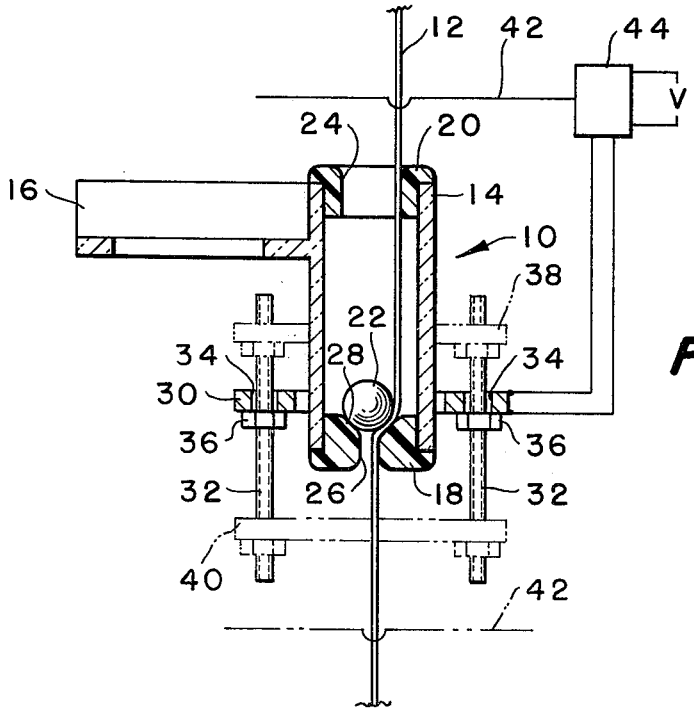
FIG. 3 is a modification of the tension control shown in FIG. 1.

Looking now to FIG. 3, a modification of FIGS. 1 and 2, is shown in that the magnet 30 is an electromagnet and a tension sensing transducer element 42 is located in contact with the yarn 12 and is used to vary the current flowing to the magnet 20, depending on the yarn tension, through a suitable control 44 which accepts the force analysis measurement from the element 42 to regulate the current to the electromagnet 30. In this manner a semi-feedback loop is established and the system will respond to hold the output tension at a desired predetermined level authomatically. Obviously, the transducer element 42 could be located at the input side of the tension control 10 as indicated in dotted lines.

To explain the above, take the example when tension in the incoming yarn increases for any reason, the transducer element 42 sensing this increase will move to change the current flow by providing a signal to the controller 44 to reduce the current and thereby effective weight of the ball 22. Conversely, if the tension should increase, the opposite will take place.

It is obvious that I have provided a simple and efficient way to change and control the amount of force exerted by the ferrous ball member in a tension control device. Other changes may be made without departing from the scope or spirit of my invention and I desire to be limited only by the scope of the claims.

I claim:

1. A yarn tension control device comprising: an elongated housing, means forming a yarn outlet in said housing, means forming a yarn inlet in said housing, a first eyelet mounted in said yarn inlet in said housing having a first opening therethrough for the passage of yarn, a second eyelet mounted in said yarn outlet having a second opening therethrough having a diameter greater than the diameter of said first opening, a metallic ball freely supported in said housing on said first eyelet for applying a retarding force to a yarn passing through said eyelets, an electro-magnet mounted adjacent to and operably associated with said metallic ball for applying a force to said metallic ball and means adjacent said yarn outlet responsive to the tension on the yarn exiting from said yarn outlet to regulate the current to said electro-magnet to adjust the force of the electro-magnet on said metallic ball and thereby said retarding force on said yarn.

2. The tension control device of claim 1 which said electro-magnet telescopes said housing.

* * * * *